United States Patent [19]

Durham

[11] 4,051,829

[45] Oct. 4, 1977

[54] AUDIBLE ENRICHMENT BLEED WARNING DEVICE FOR FUEL-INJECTED ENGINES

[76] Inventor: Roger Owen Durham, 3944 Marathon St., Los Angeles, Calif. 90029

[21] Appl. No.: 629,140

[22] Filed: Nov. 5, 1975

[51] Int. Cl.[2] ..... F02B 77/00

[52] U.S. Cl. ..... 123/198 D; 123/119 D; 123/140 MP

[58] Field of Search ..... 123/198 R, 198 D, 141, 123/124 R, 119 D, 140 MP

[56] References Cited

U.S. PATENT DOCUMENTS

| | | | |
|---|---|---|---|
| 3,164,451 | 1/1965 | Almquist | 48/180 R |
| 3,354,876 | 11/1967 | Durham | 123/140 MP X |
| 3,730,160 | 5/1973 | Hughes | 123/141 |
| 3,765,388 | 10/1973 | Durham | 123/140 MP X |
| 3,815,565 | 6/1974 | Stelter | 123/141 |

*Primary Examiner*—Ronald H. Lazarus
*Assistant Examiner*—Ira S. Lazarus

[57] ABSTRACT

An audible enrichment bleed warning device, for fuel-injected engines having an enrichment bleed, emits an audible warning that the enrichment bleed is open and extra fuel is being delivered to the engine, reminding the operator to close it after the engine has warmed. The warning device may be a horn or a whistle.

6 Claims, 1 Drawing Figure

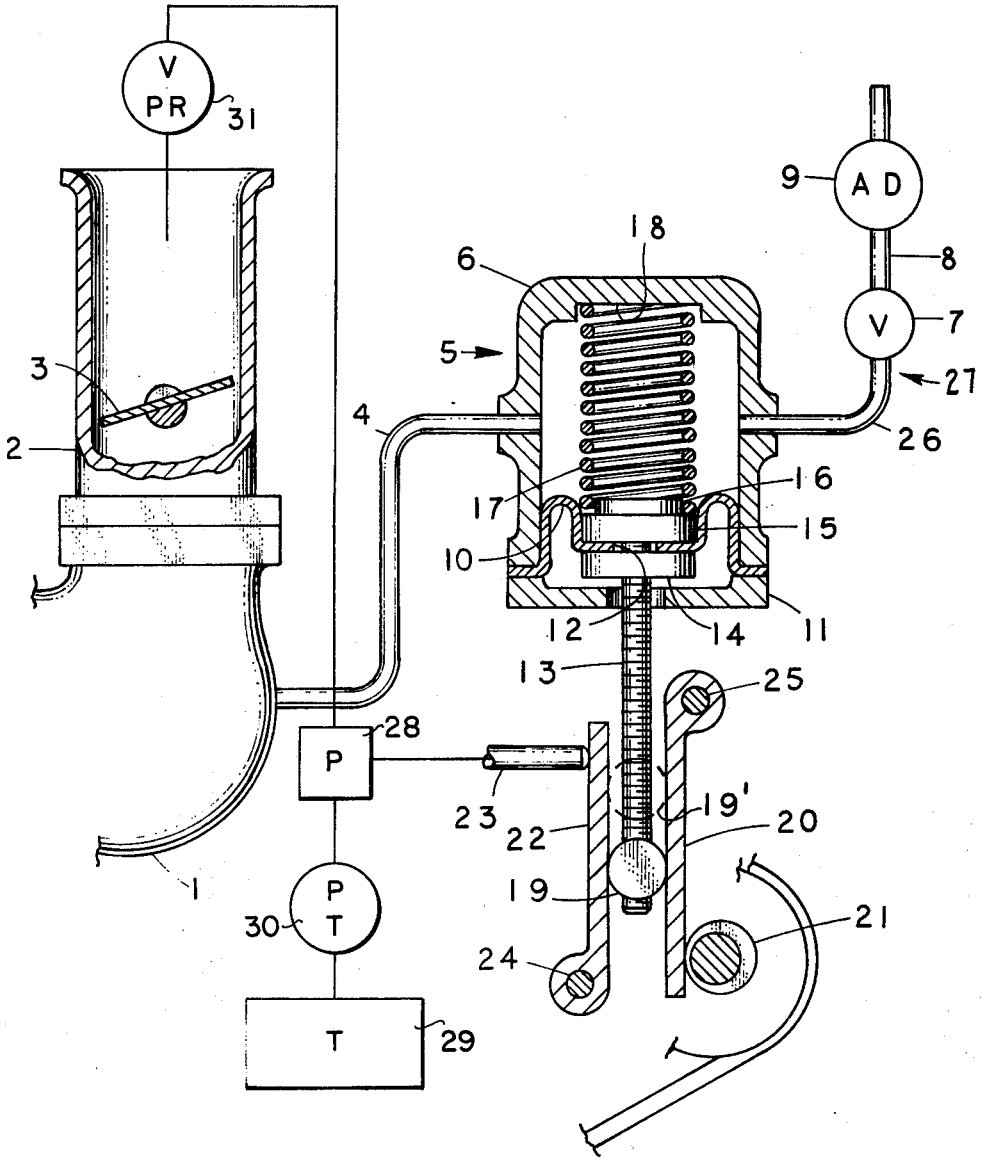
V
PR
31
9
A D
8
V
7
27
26
18
6
5
3
4
2
16
17
15
10
11
12
14
13
25
28
P
23
19'
22
20
1
P
T
30
19
21
24
T
29

AUDIBLE ENRICHMENT BLEED WARNING DEVICE FOR FUEL-INJECTED ENGINES

CROSS REFERENCE TO RELATED PATENTS:

No. 3,765,388 Mixture Control Durham Oct. 16, 1973
No. 3,354,876 Fuel Injection System Durham Nov. 18, 1967

BACKGROUND OF THE INVENTION

This invention pertains to fuel injection systems for internal combustion engines, and in particular to ways for increasing the amount of fuel delivered during warm-up.

In many fuel injection pumps, the stroke of the pump is varied according to the amount of air, or the air pressure, within the intake manifold.

Often a tube will connect from the intake manifold to a sensing cylinder means which controls the stroke of the pump. In a variable-leverage fuel injection pump, the sensing cylinder means is connected to a power fulcrum, which it extends or retracts, according to changes in pressure within the intake manifold.

The power fulcrum, in turn, varies the lengths of lever arms within the fuel injection pump transmission, varying the stroke of a pump element. The stroke of the pump increases with an increase in pressure within the intake manifold, and decreases with a decrease in the pressure within it.

When an engine is started from cold, and until it warms itself, additional fuel must be supplied, or the engine will run poorly or quit entirely.

A convenient way to supply such a rich mixture is by temporarily opening the sensing cylinder to the outside air (which is called bleeding it), to abnormally raise the pressure inside the sensing cylinder, increasing the stroke of the pump element, and causing the engine to receive as much fuel as it would with an open throttle.

To accomplish this, a bleed tube is extended from the sensing cylinder to within the operator's reach, and is connected to a valve which is opened to enrich the mixture.

In a few minutes, after the engine has warmed itself, the enrichment bleed is closed and the engine operates normally.

If the enrichment bleed means is left open after the engine has warmed, it will run poorly, and fuel will be wasted.

Parenthetically, the question may be asked as to why the enrichment bleed should not be automatically controlled by a thermostatically controlled valve. The answer is that all automatic devices are subject to partial or complete failure, usually without giving an indication of such failure to the operator. They may function correctly when they leave the factory, but sooner or later—maybe ten years later—they'll quit working, with bad results. A manual enrichment bleed is too simple to fail.

In the coming years, with ever-increasing fuel scarcity and cost, drivers will want to operate their engines as economically as possible, which will be an important factor in the success of a manual enrichment bleed system.

The problem is to provide some sure means of keeping the open enrichment bleed on the operator's mind until he closes it.

SUMMARY OF THE INVENTION

According to the invention, during starting and warm-up of a fuel-injected internal combustion engine having an enrichment bleed, air bled into the sensing cylinder operates an audible enrichment bleed warning device, reminding the operator of the enrichment. The warning noise stops when the enrichment bleed is closed. The audible enrichment bleed warning device may be a simple air-operated horn or whistle.

BRIEF DESCRIPTION OF THE DRAWING

An audible enrichment bleed warning device is shown, in diagramatic form, along with an enrichment bleed means, a sensing cylinder means, and an intake manifold and throttle means. The sensing cylinder means is connected to a power fulcrum which is shown engaging elements of a variable stroke fuel injection pump.

The fuel system itself is shown diagramatically to include a fuel tank, a transfer pump, the variable-stroke pump mechanism, which is actuated by a pump element, and a pressure-relief valve through which fuel passes before it is admitted to the airstream above the throttle.

DETAILED DESCRIPTION OF THE DRAWING

An internal combustion engine has an intake manifold 1. The amount of air entering the engine is regulated by a throttle means 2, havng a throttle butterfly 3.

A tube 4 is connected to a housing 6 of a sensing cylinder means 5, and to said intake manifold 1.

An enrichment bleed means 27 is comprised of a bleed valve 7 and a bleed tube 26, which connects between said housing 6 and said bleed valve 7. A tube 8 connects the bleed valve 7 to an air-operated, audible enrichment bleed warning device 9. Said audible enrichment bleed warning device 9 might be a horn or a whistle.

Within said sensing cylinder means 5, a rolling diaphragm 10 is clamped between said housing 6 and a face-plate 11, forming a seal between the two members.

At its center, said rolling diaphragm 10 has a central hole 12, through which a threaded control rod 13 is inserted. A lower boss 14 engages said control rod 13 by threads, as does an upper boss 15; said rolling diaphragm 10 is clamped and sealed between the two.

Said upper boss 15 has a register 16 for engaging one end of a spring 17. The other end of the spring 17 is seated in a register 18 formed in said housing 6.

A cylindrical power fulcrum 19 engages said threaded control rod 13, and is positioned between two reversed levers. A first lever 20, pivotally supported by a shaft 25, is caused to oscillate by an engine-driven eccentric 21. A second lever 22, pivotally supported by a shaft 24, actuates a pump element 23. The stroke of said pump element 23 determines the amount of fuel pumped to the engine during each turn of the pump. The pump element 23 is shown engaging a variable-stroke pump mechanism 28, shown only diagramatically, as are other elements of a fuel system which includes a fuel tank 29, a transfer pump 30, a pressure-relief valve 31, and interconnecting tubing.

The power fulcrum 19 is shown in the position it occupies when the throttle butterfly 3 is open, or when the bleed valve 7 is open, at which time the stroke of said pump element 23 is at its maximum. When the throttle butterfly 3 and the bleed valve 7 are both closed, the control rod 13 retracts said power fulcrum 19 to a position shown as 19′, at which time the stroke of the pump element 23 is decreased.

While the sensing cylinder shown is one which uses a rolling diaphragm, it could be one of several different types: one such alternate type employs a piston and a seal, instead of the diaphragm; another alternate type uses an evacuated metal bellows. The phrase, "sensing cylinder means", is intended to include such alternate constructions.

MODE OF OPERATION

When the engine is to be started from cold, the operator opens bleed valve 7, which artificially increases the pressure within said housing 6, extending the power fulcrum 19, and increasing the stroke of the pump element 23, thus providing a very rich mixture.

With said bleed valve 7 open and the engine running, air is drawn through the air-operated audible enrichment bleed warning device 9, emitting a sound which reminds the operator of the open bleed and rich running condition.

After the engine warms, the operator closes the bleed valve 7, the sound ceases, and the power fulcrum 19 responds normally to changes in pressure within the intake manifold 1.

I claim:

1. In a fuel injection system for an internal combustion engine, said fuel injection system having a variable-stroke pump mechanism wherein the stroke is determined by a power fulcrum positioned by a sensing cylinder means which is connected to the intake manifold of the engine, and wherein an enrichment bleed means, comprising a bleed tube connected to said sensing cylinder means and an operator-controlled bleed valve connected to the bleed tube, whereby the pressure within the sensing cylinder means can be abnormally raised by opening the bleed valve, thus increasing the "stroke of the variable pump mechanism; on" an audible enrichment bleed warning device connected to said enrichment bleed means, and operated by air passing through said bleed valve when it is open, said audible enrichment bleed warning device capable of omitting sounds audible to the operator and reminding him of the open enrichment bleed valve and rich running condition of the engine.

2. Apparatus according to claim 1, wherein said audible enrichment bleed warning device is a whistle.

3. Apparatus according to claim 1, wherein said audible enrichment bleed warning device is a horn.

4. In an internal combustion engine having a fuel injection system with a manifold pressure sensing cylinder means and an enrichment bleed means connected to said sensing cylinder means, whereby the enrichment bleed means can be opened during warmup, causing the fuel injection system to provide a rich mixture to the engine; an audible enrichment bleed warning device connected to said enrichment bleed means, said audible enrichment bleed warning device operated by air passing through said enrichment bleed means when it is open, and adapted for providing an audible warning to the operator that the enrichment bleed means is open, and that it should be closed as soon as the engine has warmed.

5. Apparatus according to claim 4, wherein said audible enrichment bleed warning device is a whistle.

6. Apparatus according to claim 4, wherein said audible enrichment bleed warning device is a horn.

* * * * *